US006071381A

United States Patent [19]

Leinonen

[11] Patent Number: 6,071,381

[45] Date of Patent: Jun. 6, 2000

[54] METHOD AND ARRANGEMENT IN A WEB FORMER FOR PREVENTING REWETTING OF A WEB

[75] Inventor: Antti Leinonen, Laukaa, Finland

[73] Assignee: Valmet Corporation, Helsinki, Finland

[21] Appl. No.: 09/068,145

[22] PCT Filed: Aug. 22, 1997

[86] PCT No.: PCT/FI97/00487

§ 371 Date: May 4, 1998

§ 102(e) Date: May 4, 1998

[87] PCT Pub. No.: WO98/10138

PCT Pub. Date: Mar. 12, 1998

[30] Foreign Application Priority Data

Sep. 6, 1996 [FI] Finland ..... 963494

[51] Int. Cl.[7] ..... D21F 1/48; D21F 1/00

[52] U.S. Cl. ..... 162/217; 162/306; 162/363

[58] Field of Search ..... 162/306, 307, 162/202, 217, 363, 364

[56] References Cited

U.S. PATENT DOCUMENTS

| | | | |
|---|---|---|---|
| 2,714,342 | 8/1955 | Beachler | 162/370 |
| 2,843,025 | 7/1958 | Holden | 162/306 |
| 3,758,380 | 9/1973 | Hawkings | 162/306 |
| 4,980,979 | 1/1991 | Wedel | 162/370 |
| 5,034,100 | 7/1991 | Sides | 162/306 |

FOREIGN PATENT DOCUMENTS

| | | | |
|---|---|---|---|
| 0371786 | 6/1990 | European Pat. Off. . | |
| 87/06633 | 11/1987 | WIPO | 162/352 |

OTHER PUBLICATIONS

"Role Of Felt in Wet Pressing", Z. Szikla and A. Palokangas, Paperi Ja Puu (Paper and Timber), 73(1991); 3.

*Primary Examiner*—Karen M. Hastings
*Attorney, Agent, or Firm*—Steinberg & Raskin, P.C.

[57] ABSTRACT

The invention relates to a method for preventing rewetting of a web in a former. Water is removed from the web (W) by means of dewatering members. The web (W) is formed by forming members and forming rolls on support of a wire loop/loops. The wire loop/loops (10) is/are guided by alignment, guide and/or suction rolls (11, 12). The web (W) supported by a wire (10) is passed by at least two vacuum boxes/chambers (16, 17) after the last suction roll (11). At least two vacuum boxes/chambers (16, 17) are fitted after the last suction roll (11). The web (W) and the wire (10) are arranged to be dewatered by means of a first vacuum box/chamber (16). The transport of moisture from the wire (10) back into the web (W) is prevented by means of a second vacuum box/chamber (17), and a vacuum ($P_1$) in the first vacuum box/chamber (16) is higher than a vacuum ($P_2$) in the second vacuum box/chamber (17).

17 Claims, 3 Drawing Sheets

METHOD AND ARRANGEMENT IN A WEB FORMER FOR PREVENTING REWETTING OF A WEB

FIELD OF THE INVENTION

The invention relates to a method for preventing rewetting of a web in a web former, in which method water is removed from the web by means of dewatering members and the web is formed by means of forming members and forming rolls on support of a wire loop/loops, and in which method the wire loop/loops is/are guided by means of alignment, guide and/or suction rolls.

The invention also relates to an arrangement for preventing rewetting of a web in a web former, which web former comprises web forming members and web forming rolls, dewatering members and a wire loop/loops as well as alignment, guide and suction rolls for the wire loop/loops.

BACKGROUND OF THE INVENTION

In the oldest methods of forming a continuous paper or board web, which are still most commonly applied, forming of the web takes place in a horizontal so-called fourdrinier wire section, or a planar wire section. In addition, two main groups may be distinguished among the wire sections, or the former types, namely actual twinwire formers and so-called hybrid formers. In the actual twin-wire formers, forming of the web takes place from beginning to end between two wires. In the hybrid formers, the web is formed first onto one wire, after which this partly formed web is passed to a dewatering zone that is being formed between two wires for final stabilization of the mutual position of fibres.

One problem in the formers known from prior art is rewetting of the web. For instance, when a suction box of high vacuum is used in a former, even after the box there still occurs rewetting of the web, which is very difficult to prevent, before the web is transferred to a press section. On the other hand, it is known that wires all the time carry water in an amount of their own mass under normal running conditions, which water tends to move to the web if there is no force or another arrangement to prevent it.

Conventionally, vacuum zones, for instance, in suction rolls have been connected so as to be rising e.g. the first chamber of 25 kPa and the second chamber of 66 kPa in the case where attempts are made to increase the solids proportion without clogging up the web. A suction box of high vacuum is sought to be placed so that it is the last dewatering element in the former. It is known that solids may be increased by a high vacuum, but it is difficult to maintain the obtained solids.

With respect to prior art, reference may be made to the magazine article of *Szikla, Palokangas, Role of felt in wet pressing, Paperi ja Puu* 73, 1991, reporting an investigation of press felts in which it was observed that a vacuum of 20–40 kPa is enough to hold the water in the felt after a nip, thereby minimizing rewetting in a press. This result has been obtained with modern felts, in which the resistance to flow is small.

With respect to prior art, reference may also be made to EP Patent Applicaton No. 0 371 786, which discloses a web forming method and apparatus, the method disclosed being applied in a wire section of a paper machine or equivalent, which wire section is formed by a bottom wire loop with the main portion of its top run being substantially horizontal and a top wire loop cooperating therewith, and in which method a fibre suspension coming out of a headbox of the paper machine is supplied to the first part of the top run of said bottom wire loop, said part forming a first dewatering zone, after which the fibre layer from which part of the water has been removed is passed to a second dewatering zone, in the area of which said top wire loop is caused to cover said fibre layer, from which part of the water has been removed, such that the removal of water from the fibre layer continues at least in two stages in the area of said second dewatering zone, after which the top wire loop is separated from the nearly formed fibre web, which is guided to follow the run of the bottom wire loop forwards for the following processing stages of the web. In connection with this prior-art arrangement a separation suction box has been used in the downwards slanting run of the bottom wire between a forming roll and a suction roll, the purpose of said suction box being to ensure that the web does not follow the wire, which returns to the wire section, but is transferred from the wire section to a press section. In this known arrangement the web, supported by the bottom wire and ensured by the suction box, moves over the suction roll to the run between it and the drive roll of the wire, from which the web is transferred, in a way known in itself, by means of a pick-up roll and a felt forwards to the press section of the paper machine. However, in this arrangement no attention has been paid to prevention of rewetting.

OBJECTS AND SUMMARY OF THE INVENTION

An object of the present invention is to disclose an arrangement by which rewetting of the web is prevented.

A specially important object of the invention is to ensure a sufficient solids content when transition is made from a wire section to a press section, thereby enabling the speed of the paper machine to be increased.

With a view to achieving the objectives stated above and those that will come out later, the method of the invention is mainly characterized in that, in the method, a web supported by a wire is passed by at least two vacuum boxesichambers after the last suction roll or equivalent in a web former such that, in the running direction of the web, by means of a first vacuum box/chamber moisture is sucked out of the web and the wire by a first vacuum and by means of a second vacuum box/chamber the transport of moisture from the wire back into the web is prevented by a second vacuum, and that the first vacuum is higher than the second vacuum.

The arrangement of the invention is, in its turn, mainly characterized in that at least two vacuum boxes/chambers are fitted after the last suction roll or equivalent in a web former, that a web and a wire are arranged to be dewatered by means of a first vacuum box/chamber and the transport of moisture from the wire back into the web is arranged to be prevented by means of a second vacuum box/chamber, and that the vacuum in the first vacuum box/chamber is higher than the vacuum in the second vacuum box/chamber.

In accordance with the invention, rewetting of the web is prevented such that the water adhering to the threads and the bottom face of the wire is prevented from getting again into contact with the web by sucking into a vacuum box and/or by forcing the water to remain on the threads/the side of the bottom face of the wire by means of a vacuum acting in the box.

In accordance with the invention, at the end of the wire section just before the web is passed to a press section, a second low-pressure chamber is placed in the suction box of high vacuum after actual dewatering, and by performing the transfer of the web to a press at this chamber or immediately after it, rewetting can be prevented.

This arrangement also makes it possible to optimize the vacuum in the high-vacuum chamber. The vacuum may be dropped, if needed, after rewetting is no problem. In addition, the vacuum in the chamber of lower vacuum may also be minimized to a point where no rewetting occurs.

If needed, the chamber on the outlet side, or the chamber of lower vacuum, is divided into transverse sections, which can be regulated together and/or separately, in which case, for instance, the edges of the web may be treated differently from the middle part of the web.

BRIEF DESCRIPTION OF THE DRAWINGS

In the following, the invention is described in more detail with reference to the figures of the accompanying drawing, in which FIG. 1 schematically shows the arrangement in accordance with the invention in a wire section.

DETAILED DESCRIPTION OF THE INVENTION

Figure 1:
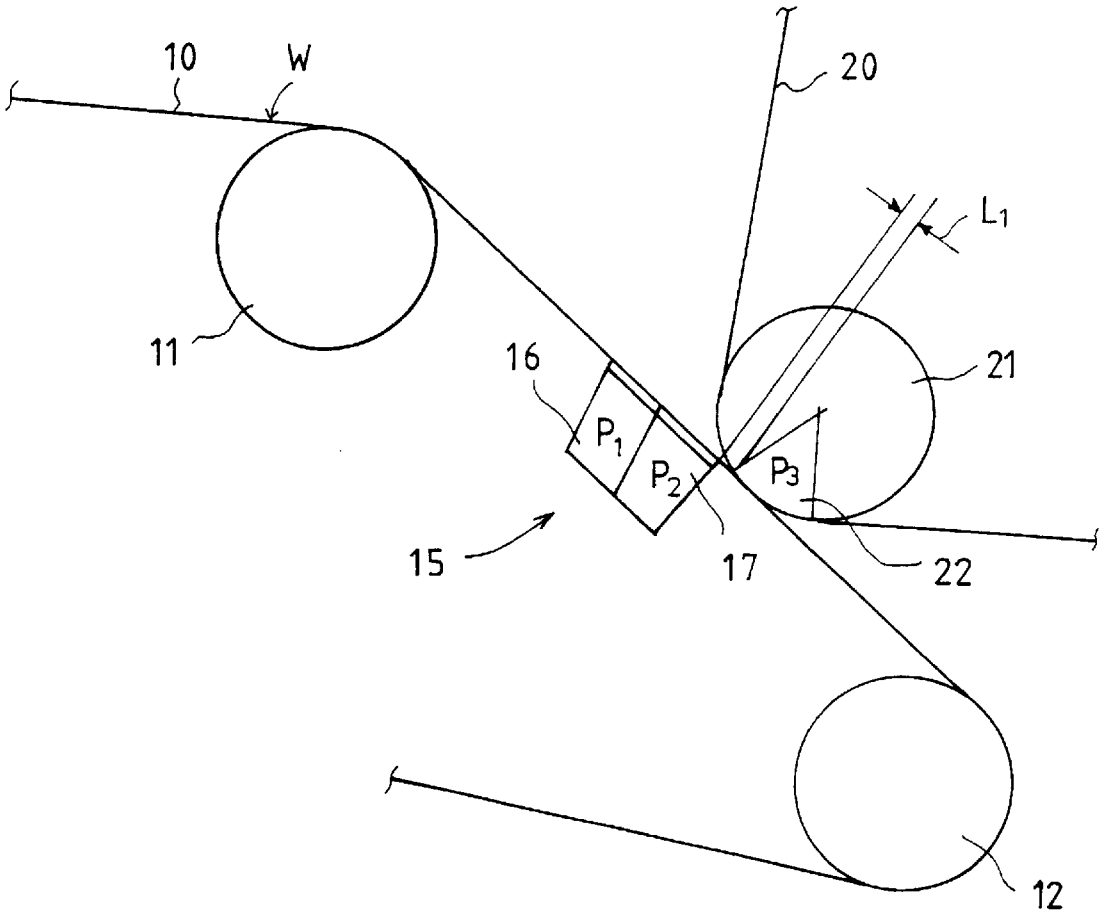

FIG. 1 schematically shows the arrangement in accordance with the invention at the end of a wire section of a paper machine, just before transition to a press section. A wire of the wire section is denoted with the reference numeral 10 and a wire of the press section is denoted with the reference numeral 20. From the last suction roll 11 of the wire section the wire 10 leads the web by a suction box 15, which comprises first a high-pressure suction chamber 16 having a vacuum $P_1$ of about 45–75 kPa, preferably 50–65 kPa, and it is followed by a chamber 17 of lower vacuum, by means of which rewetting is inhibited. The vacuum $P_2$ of this chamber is about 15–45 kPa, preferably 35–40 kPa. After that there is a pick-up roll 21 of the wire section, whose suction zone is denoted with the reference numeral 22 and vacuum with $P_3$, which is about 25–45 kPa, preferably 30–35 kPa. In accordance with the invention, the chamber 17 of lower vacuum and the suction zone 22 of the pick-up roll are as close to each other as possible, even partly overlapping. The distance $L_1$ may be, for instance, $L_1$=0–500 mm, preferably $L_1$=0–100 mm. The chamber 17 of lower vacuum $P_2$ may also be partly overlapping with the suction zone 22/suction aperture of the pick-up roll, preferably one on top of the other.

Figure 2:
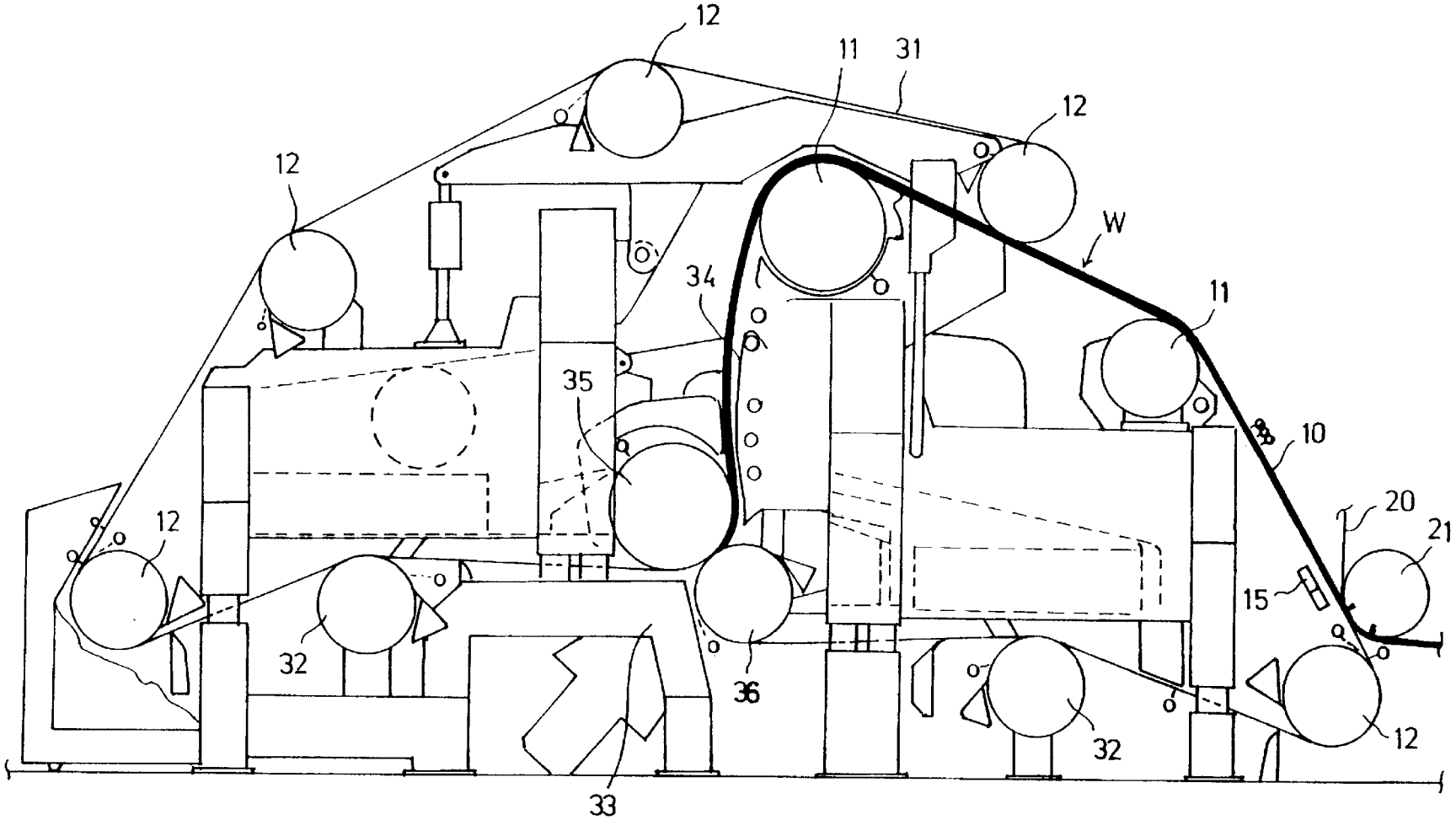
FIGS. 2 and 3 schematically show formers of different types, in connection with which the arrangement in accordance with the invention may be applied.
Figure 3:
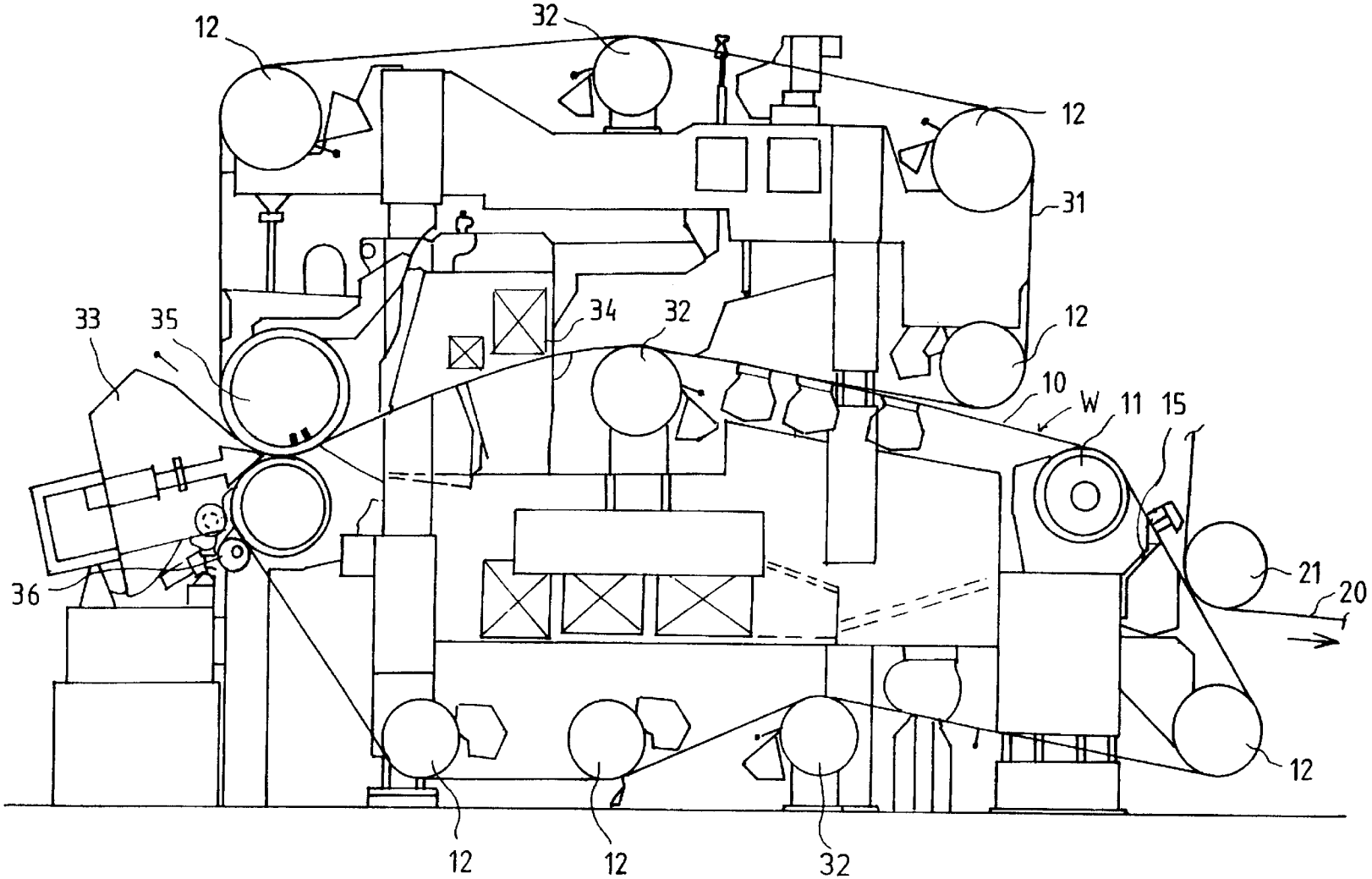

FIGS. 2 and 3 show schematically wire sections of a paper machine in which the arrangement of the invention has been disposed in order to prevent rewetting of the web during transition from the wire section to a press section. The parts corresponding to those of FIG. 1 have been denoted with the same reference numerals and the parts corresponding to one another in FIGS. 2 and 3 have been denoted with the same reference numerals.

In the web formers shown in FIGS. 2 and 3, the web is formed between wire loops 10 and 31, which wire loops are provided with alignment, guide and suction rolls 32,12,11. Pulp is supplied from a headbox 33 onto an initial portion of one wire loop 10, after which water is removed from pulp by means of dewatering members 34. The web is formed by forming rolls 35 and the breast roll of the web former is denoted with the reference numeral 36. A suction box 15 in accordance with the invention is disposed after the last suction roll 11, after which the web is guided to a press section.

The arrangement in accordance with the invention for prevention of rewetting of the web is, of course, suitable for use in connection with wire sections of other types than those illustrated in FIGS. 2 and 3 provided that the end of the wire section before the web is transferred to a press section is so arranged in structure that the arrangement of the invention can be disposed there just before or at the pick-up roll. For instance, in such a way that the distance $L_1$=0–500 mm or the arrangement extends so as to be at the pick-up aperture, preferably at it or $L_1$=0–100 mm.

Above, the invention has been described only with reference to some of its preferred embodiments, to the details of which the invention is, however, in no way intended to be narrowly confirmed. Many modifications and variations are possible within the scope of the inventive idea defined in the following claims.

I claim:

1. A method for preventing rewetting of a web in a web former, in which water is removed from the web (W) by means of dewatering members (34) and the web (W) is formed by means of forming members and forming rolls (35) on support of a wire loop/loops (10,31), and in which method the wire loop/loops (10,31) is/are guided by means of alignment, guide and/or suction rolls (11,12,32), characterized in that, in the method, the web (W) supported by a wire (10) is passed by at least two vacuum boxes/chambers (16,17) after the last suction roll (11) or equivalent in the web former such that, in the running direction of the web (W), by means of a first vacuum box/chamber (16) moisture is sucked out of the web (W) and the wire (10) by a first vacuum ($P_1$) and by means of a second vacuum box/chamber (17) the transport of moisture from the wire (10) back into the web (W) is prevented by a second vacuum ($P_2$), and the first vacuum ($P_1$) is higher than the second vacuum ($P_2$) each of said first vacuum box/chamber (16) and said second vacuum box/chamber (17) being positioned prior to a pick up roll of said web former so that said web passes each of said first vacuum box/chamber (16) and said second vacuum box/chamber (17) prior to contacting said pick up roll.

2. A method as claimed in claim 1, characterized in that, in the method, the web (W) and the wire (10) are passed by the vacuum boxes/chambers (16,17) substantially immediately before the web (W) is passed to a press section.

3. A method as claimed in claim 1, characterized in that, in the method, the first vacuum box/chamber (16) produces a vacuum ($P_1$) of 45–75 kPa.

4. A method as claimed in claim 1, characterized in that, in the method, the second vacuum box/chamber (17) produces a vacuum ($P_2$) of 15–45 kPa.

5. An arrangement for preventing rewetting of a web in a web former, which web former comprises web forming members and web forming rolls (35), dewatering members (34) and a wire loop/loops (10,31) as well as alignment, guide and suction rolls (11,12,32) for the wire loop/loops, comprising at least two vacuum boxes/chambers (16,17) fitted after the last suction roll (11) or equivalent in the web former and prior to said web contacting a pick up roll of said web former, that the web (W) and a wire (10) are arranged to be dewatered by means of a first one of said at least two vacuum boxes/chambers and the transport of moisture from the wire (10) back into the web (W) is arranged to be prevented by means of a second one of said at least two vacuum boxes/chambers, and the vacuum ($P_1$) in said first one of said at least two vacuum boxes/chambers is higher than the vacuum ($P_2$) in the second one of said at least two vacuum boxes/chambers.

6. An arrangement as claimed in claim 5, characterized in that the vacuum boxes/chambers (16,17) are disposed substantially immediately before the web (W) is passed to a press section.

7. An arrangement as claimed in claim 5, characterized in that the vacuum ($P_1$) in the first vacuum box/chamber (16) is 45–75 kPa.

8. An arrangement as claimed in claim 5, characterized in that the vacuum ($P_2$) in the second vacuum box/chamber (17) is 15–45 kPa.

9. An arrangement as claimed in claim 5, characterized in that the second vacuum box/chamber is divided into sections in a direction transverse to the running direction of the web (W), which sections can be regulated separately and/or together.

10. A method for preventing rewetting of a web in a web former in which the web is formed by forming members while being supported by a wire and water is removed from the web by dewatering means, the wire being guided in a loop by alignment, guide and/or suction rolls, the improvement comprising the steps of:

arranging at least two vacuum boxes/chambers in a loop of the wire after a last one of the alignment, guide and or suction rolls in a running direction of the web prior to separation of the web from the wire and prior to said web contacting a pick up roll of a press section of said web former such that the web is passed while supported by the wire over the last roll and the over the at least two vacuum boxes/chambers, generating a first vacuum in a first one of the at least two vacuum boxes/chambers in the running direction of the web in order to remove moisture from the wire and the web supported thereby, generating a second vacuum in a second one of the at least two vacuum boxes/chambers arranged after the first vacuum box/chamber in the running direction of the web to prevent transport of moisture from the wire back into the web, and regulating the first and second vacuums such that the first vacuum is higher than the second vacuum.

11. The method of claim 10, wherein the at least two vacuum boxes/chambers are arranged substantially immediately before the web is separated from the wire and passed to a press section.

12. The method of claim 10, wherein two of the alignment, guide or suction rolls are arranged to define a substantially straight run for the wire along which the web is separated from the wire, the at least two vacuum boxes/chambers being arranged along the substantially straight run prior to separation of the web from the wire.

13. The method of claim 10, further comprising the step of dividing said second vacuum box/chamber into sections in a direction transverse to the running direction of the web such that an independently regulatable level of suction may be generated in each of said sections.

14. In a web former including web forming members for forming a web, dewatering members for dewatering the web, a wire and alignment, guide and/or suction rolls for guiding the wire in a loop to support the web, an arrangement for preventing rewetting of the web comprising:

at least two vacuum boxes/chambers arranged in a loop of the wire after a last one of the alignment, guide and/or suction rolls in a running direction of the web prior to separation of the web from the wire and prior to said web contacting a pick up roll of a press section of said web former such that the web is passed while supported by the wire over the last roll and then over the at least two vacuum boxes/chambers, said at least two vacuum boxes/chambers being structured and arranged such that a first vacuum is generated in a first one of said at least two vacuum boxes/chambers in the running direction of the web in order to remove moisture from the wire and the web supported thereon and a second vacuum is generated in a second one of said at least two vacuum boxes/chambers to prevent transport of moisture from the wire back into the web, the first and second vacuums being such that the first vacuum is higher than the second vacuum.

15. The arrangement of claim 14, wherein said at least two vacuum boxes/chambers are arranged substantially immediately before the web is separated from the wire and passed to a press section following the web former.

16. The arrangement of claim 14, wherein two of the alignment, guide or suction rolls are arranged to define a substantially straight run for the wire along which the web is separated from the wire, said at least two vacuum boxes/chambers being arranged along the substantially straight run prior to separation of the web.

17. The arrangement of claim 14, wherein said second vacuum box/chamber is divided into sections in a direction transverse to the running direction of the web such that an independently regulatable level of suction may be generated in each of said sections.

* * * * *